US005402976A

United States Patent [19]

Pollack

[11] Patent Number: 5,402,976

[45] Date of Patent: Apr. 4, 1995

[54] SLIP-ON BRACE FOR DISPLAY STANDS, FRAMES AND EASELS

[76] Inventor: Ronald M. Pollack, 53 Burns St., Forest Hills, N.Y. 11375

[21] Appl. No.: 112,135

[22] Filed: Aug. 26, 1993

[51] Int. Cl.[6] ..... A47F 5/00

[52] U.S. Cl. ..... 248/300; 40/156; 248/455; 248/469

[58] Field of Search ..... 248/300, 456, 455, 488, 248/461, 469; 40/156, 152.1

[56] References Cited

U.S. PATENT DOCUMENTS

| | | | |
|---|---|---|---|
| 12,721 | 11/1907 | Englefield | 248/455 |
| 4,065,091 | 12/1977 | Ulrich | 248/488 X |
| 4,555,128 | 11/1985 | White | 248/456 X |
| 4,669,209 | 6/1987 | Pollack | 40/152.1 |
| 4,798,015 | 1/1989 | Ackeret | 248/455 X |
| 4,986,013 | 1/1991 | Pollack | 40/156 X |
| 5,121,563 | 6/1992 | Connor | 40/152.1 X |
| 5,243,777 | 9/1993 | Dedlow | 40/156 X |
| 5,263,576 | 11/1993 | Boreen | 40/152.1 X |
| 5,290,003 | 3/1994 | Reyes | 248/461 |

*Primary Examiner*—J. Franklin Foss
*Attorney, Agent, or Firm*—Galgano & Burke

[57] ABSTRACT

A slip-on brace is provided for display stands, frames and easels of the type having an elongated frame element having front and rear legs defining a slot for the receipt of a generally planar display element. The brace includes a generally planar brace element having two opposite lateral edges angularly disposed relative to one another, and a pair of upstanding flanges each of which is joined to and along one of the lateral edges and is disposed generally normally to the planar brace element. At least one of the flanges is insertable into the slot of the elongated frame element in a friction fit manner between the display element and the frame element rear leg. The other flange can be inserted into the slot of another display stand to join the stands together or it can be used to prop up the first stand on a horizontal support, such as a table or shelf.

23 Claims, 4 Drawing Sheets

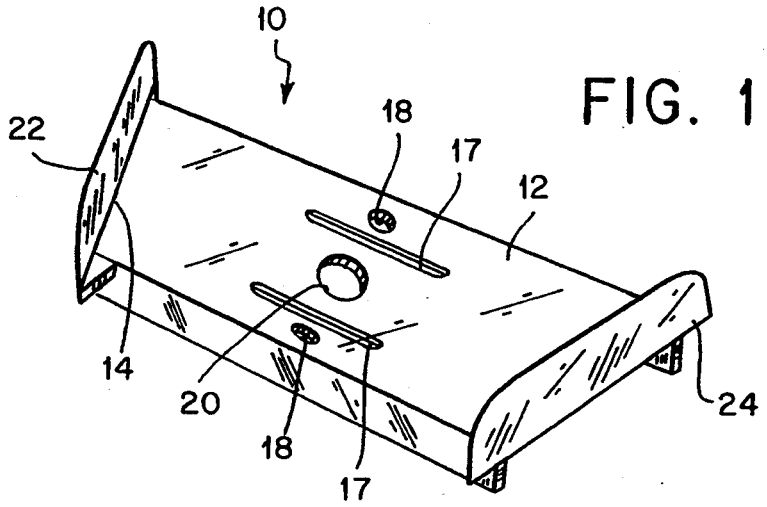
FIG. 1
FIG. 2
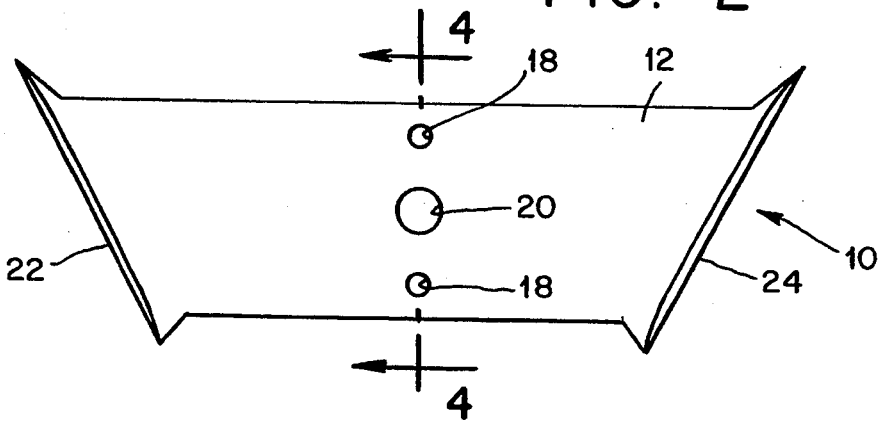
FIG. 3
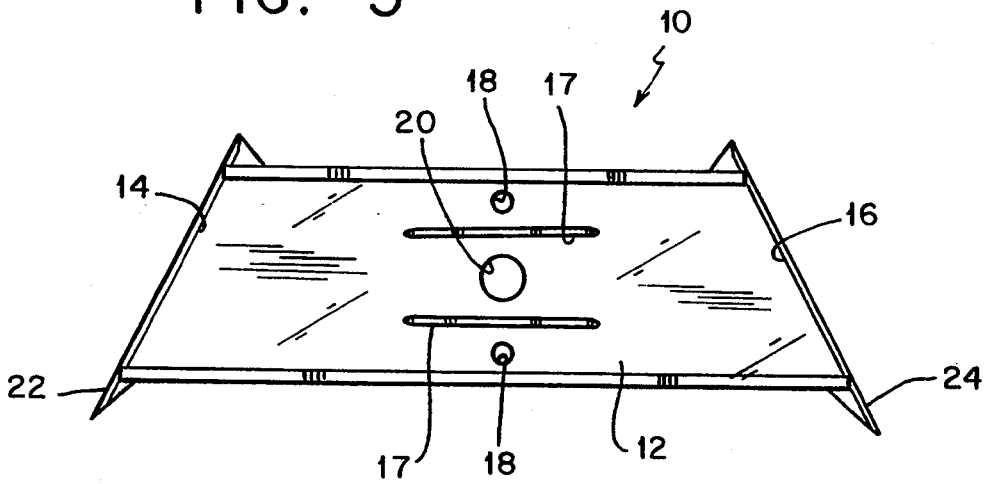

FIG. 8
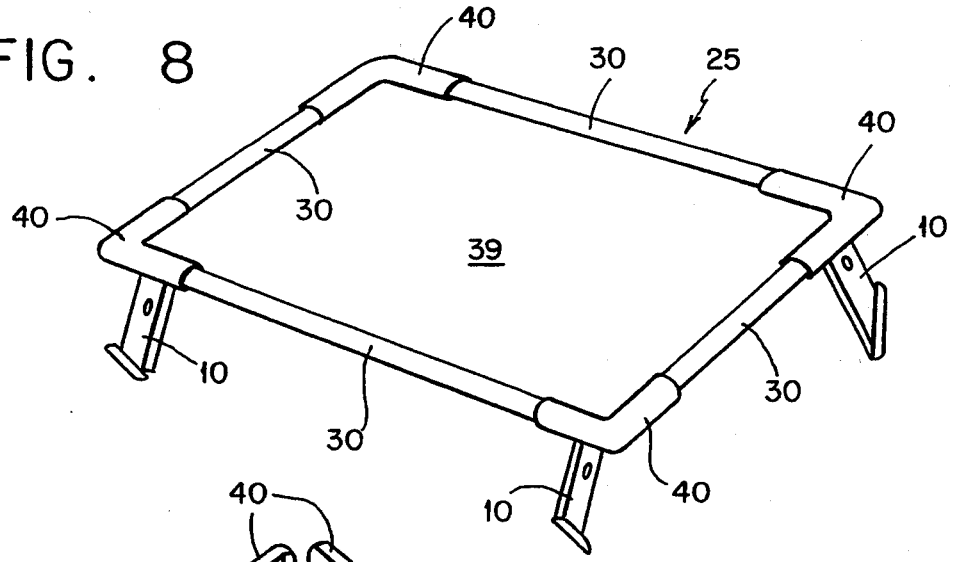
FIG. 9
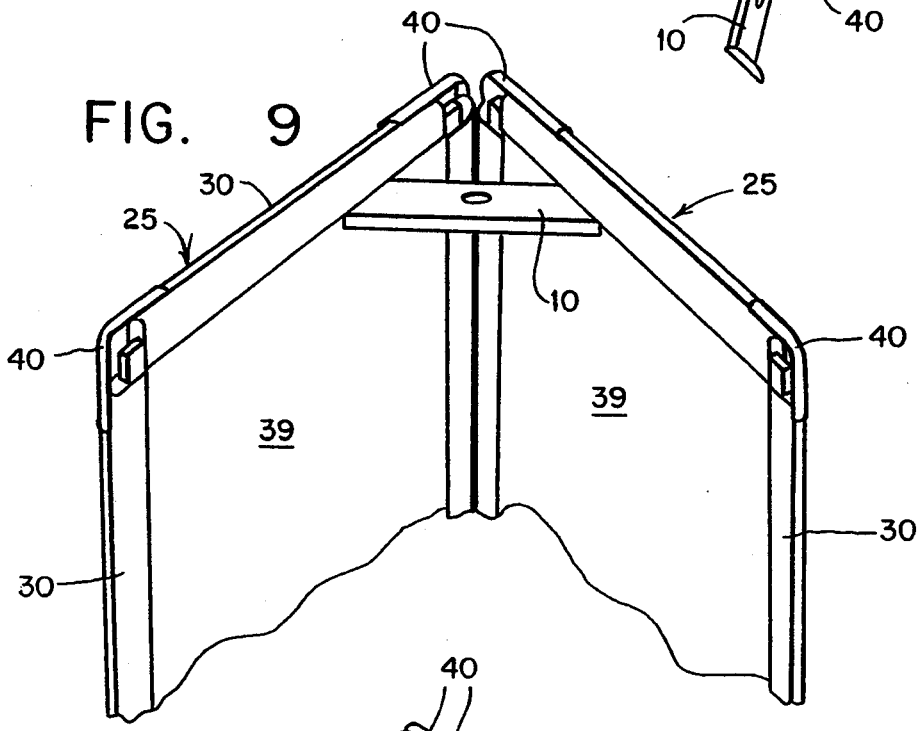
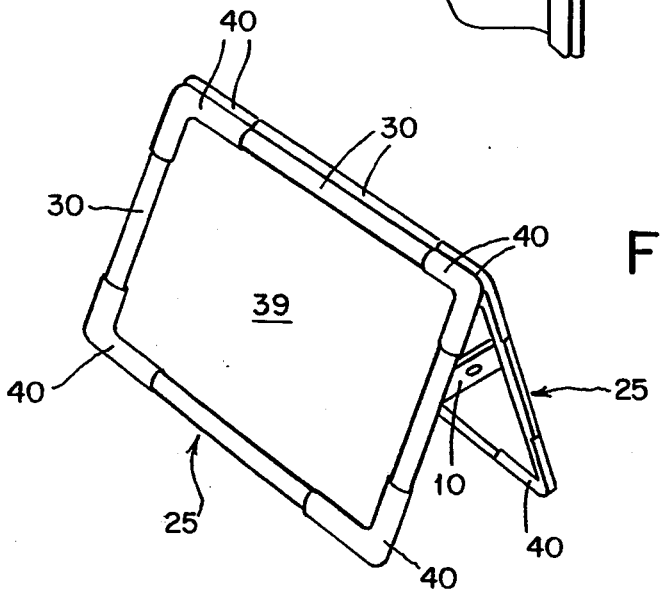
FIG. 10

SLIP-ON BRACE FOR DISPLAY STANDS, FRAMES AND EASELS

BACKGROUND OF THE INVENTION

1. Field of the Invention

The present invention relates to a slip-on brace for display stands, frames, easels and the like. More particularly, it relates to such a slip-on brace and display stand assembly which may be used to support a small easel or display stand or to form a multi-stand display.

In my earlier patents for a picture and a poster frame, U.S. Pat. Nos. 4,669,209 and 4,986,013, the subject matter of which is incorporated herein by reference thereto, I have described picture and poster frames which are very inexpensive and easy to assembly, and which may be used for the practical framing of a wide variety of pictures, posters, commercial signs, etc., for both residential and commercial use.

The present invention is an accessory to these and similar display stands, poster and picture frames, and easels which facilitates the coupling of several display frames or stands together, and which allows the display stand or easel to be positioned and supported in a stable manner.

SUMMARY OF THE INVENTION

Accordingly, it is an object of the present invention to provide a novel, slip-on brace and display stand and brace assembly for poster-like pictures, signs and the like which is of simple and inexpensive construction and easy and facile to install.

It is also an object of the present invention to provide such a slip-on brace which allows greater versatility of use in connection with the grouping of different display stands, pictures or signs together in a variety of positions and which also provides a stable support for easels and display stands.

Certain of the foregoing and related objects are readily attained according to the present invention by the provision of a slip-on brace for display stands, frames and easels of the type having an elongated frame element having front and rear legs defining a slot for the receipt of a generally planar display element. The brace includes a generally planar brace element having two opposite lateral edges angularly disposed relative to one another, and a pair of upstanding flanges each of which is joined to and along one of the lateral edges and is disposed generally normally to the planar brace element. At least one of the flanges is insertable into the slot of the elongated frame element in a friction fit manner between the display element and the frame element rear leg. Alternatively, the other flange serves as the foot of the brace to stand the frame on a table, counter or the like or is insertable into the slot of another elongated frame element of another display stand in a friction fit manner between the display element and the frame element rear leg so as to join said frame elements and stands together at an angular position with respect to one another.

Preferably, the lateral edges of the brace define an included angle of 60 degrees. Desirably, the brace element and flanges are integrally formed from plastic material and are injection molded. Advantageously, the brace additionally includes a weight removably securable to the brace element. Most advantageously, the brace element and the weight each have a central bore, and the brace additionally includes a removable push-type, nail-like pin clip frictionally receivable in the bores of the brace element and weight in a snap-fit manner. Most desirably, the flanges are tapered, the brace element has a pair of elongated reinforced ribs formed thereon, and at least one hole by which the brace may be hung.

Certain of the foregoing and related objects are also readily attained according to the present invention by the provision of a multiple display stand and brace assembly comprising a plurality of display stands each having a frame element having front and rear legs defining a slot for the receipt of a generally planar display element, and a plurality of the aforementioned slip-on braces for joining the display stands together at an angular position with respect to one another. At least one of the flanges is insertable into the slot of one of the elongated frame elements of one display stand in a friction fit manner between the display element and the frame element rear leg, and the other of the flanges is insertable into the slot of another elongated frame element of another display stand in a friction fit manner between the display element and the frame element rear leg so as to join said frame elements and stands together at an angular position with respect to one another.

BRIEF DESCRIPTION OF THE DRAWINGS

Other objects and features of the present invention will become apparent from the following detailed description considered in connection with the accompanying drawings which disclose several embodiments of the present invention. It should be understood, however, that the drawings are designed for the purpose of illustration only and not as a definition of the limits of the invention.

In the drawings, wherein similar reference characters denote similar elements throughout the several views:

FIG. 1 is a perspective view of the slip-on brace embodying the present invention;

FIG. 2 is a plan view thereof;

FIG. 3 is a bottom view thereof;

FIG. 8 is a perspective view showing the slip-on brace as being used to support a horizontally disposed display stand;

FIG. 9 is a fragmentarily illustrated perspective view showing the slip-on brace being used to join two display stands together at an angle of 60 degrees;

FIG. 10 is a perspective view showing the slip-on brace being used for forming a two-sided display stand or frame;

DETAILED DESCRIPTION OF THE PREFERRED EMBODIMENTS

Figure 4:
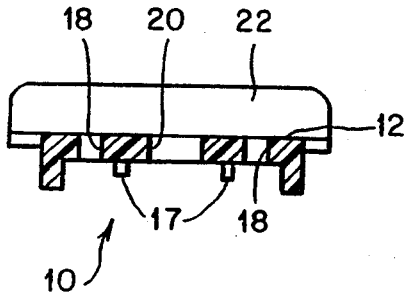
FIG. 4 is a cross-sectional view taken along line 4—4 of FIG. 2.

Turning now in detail to the drawings, and in particular to FIGS. 1–4 thereof, therein illustrated is a novel, slip-on brace for display stands, picture and poster frames, easels, and the like, embodying the present invention and generally designated by reference numeral 10. Slip-on brace 10 consists of a generally planar central brace element 12 having two opposite lateral edges 14, 16 angularly disposed relative to one another (e.g., defining an included angle of 60 degrees). In addition, the brace element 12 has a pair of reinforcing ribs 17, and a pair of holes 18, by which the brace may be hung. The brace element 12 further includes a central bore 20, the purpose of which will be described in greater detail hereinafter. A pair of upstanding, preferably tapered flanges 22, 24 are joined to, and along, one of the lateral edges 14, 16 and are disposed generally normally to the planar brace element 12.

Figure 5:
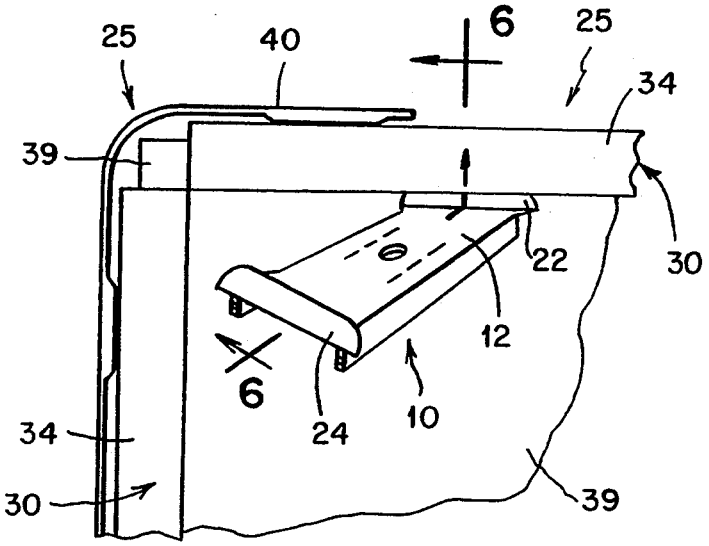
FIG. 5 is a fragmentarily illustrated rear elevational view of a display stand or frame showing the slip-on brace of the present invention being attached thereto.
Figure 6:
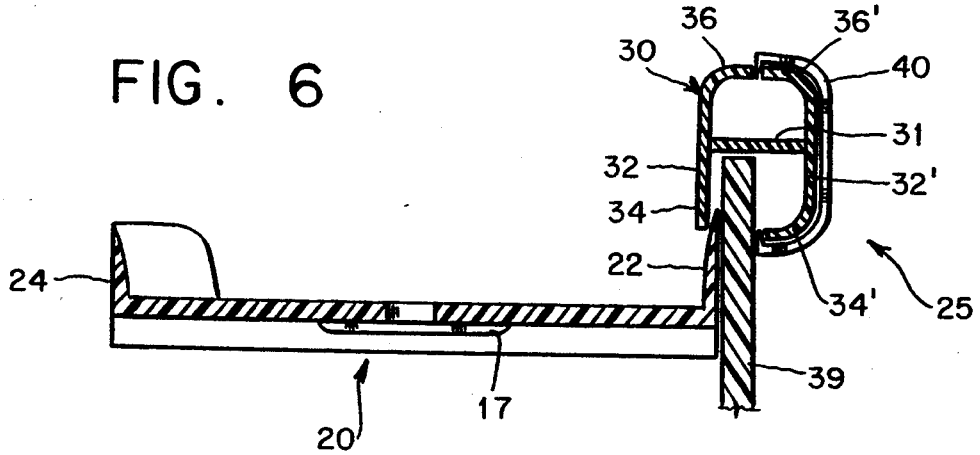
FIG. 6 is a sectional view taken along line 6—6 of FIG. 5.

FIG. 5 illustrates the slip-on brace 10 being inserted into the rear of a poster frame or stand, generally designated 25, the construction of which is described in greater detail in applicant's prior patent, U.S. Pat. No. 4,986,013. These display stands or poster frames 25, as seen best in FIG. 6, are composed of frame elements or edge supports 30 of the general type shown in FIG. 16 of U.S. Pat. No. 4,986,013.

As seen best in FIG. 6, edge supports 30 each comprise a flat, generally rectilinear base plate 31 having two opposite ends to which a pair of generally C-shaped dome members 32, 32' are interconnected in a mirror-image fashion. The C-shaped dome members 32, 32' have corresponding opposing legs 34, 34' and 36, 36', the ends of which extend toward and oppose the corresponding ends of the other dome member so as to define a gap or slot between the ends thereof for the receiving the respective edge of a poster 39; in this case due to the width of the poster, the end of leg 34 of the C-shaped dome member 32 has been cut off, or modified, to provide a straight edge to allow for the insertion of the relatively thick display board 39. These edge supports 30 are placed on each side of the poster 39 to grab the lateral edges thereof and elbow-shaped corner fastening elements 40 (of the type shown in FIG. 3 of U.S. Pat. No. 4,986,013) are used, having a substantially C-shaped configuration which basically conforms to the shape of dome member 32' of edge supports 30, but they have an inside diameter slightly smaller than the outside diameter of element 30, and inwardly-directed flanges on the ends thereof so that a snap-fit results when fastening element 40 is engaged with member 30 because of the increased tension therebetween. The details of the construction of these elements are more fully described in the aforementioned patent.

As shown in FIGS. 5 and 6, after the display stand or poster frame 25 is completed with the elbow-shaped corner fastening elements 40 locking the frame elements 30 in place, the flange 22 of slip-on brace 10 can be inserted into the slot 27 in a sandwich-like and friction-fit manner between the rear surface of the poster 39 and the leg 32 of the C-shaped dome member 32. As seen best in FIG. 6, the taper of the flange 22 facilitates the insertion of the flange 22 into this slot.

Figure 7:
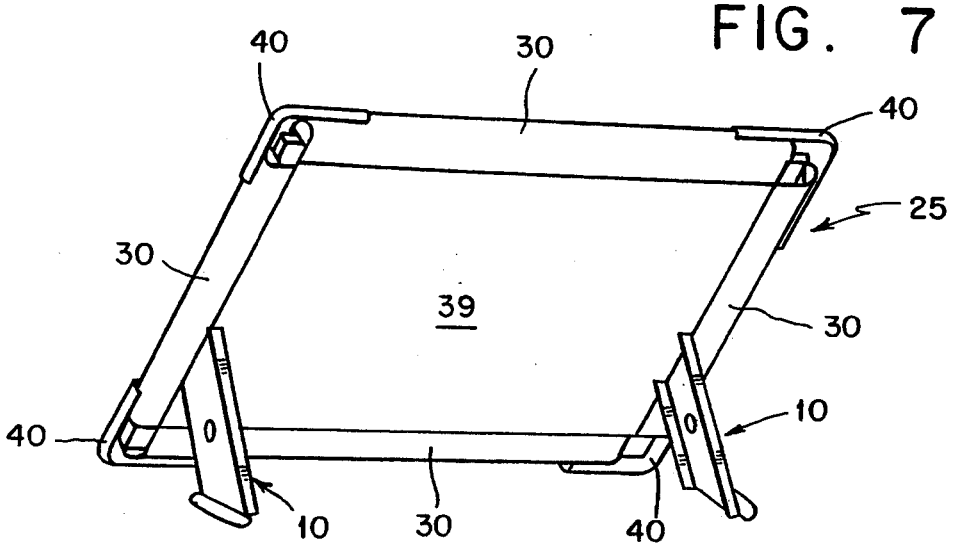
FIG. 7 is a rear perspective view showing the brace elements of the present invention being used to support an easel.

As shown in FIG. 7, a second slip-on brace 10 can be inserted into the opposite frame element of the display stand so that the same can be supported by the two braces, so as to form a standing easel.

As shown in FIG. 8, a total of four braces 10 (three of which are visible) are inserted adjacent opposite corners of two opposite sides of the stand 35 so that the display stand can be positioned in a horizontal position, supported by the braces 10, 10' which then serve as upstanding legs. Merchandise could then be displayed on the face of the horizontally disposed display stand 25.

FIG. 9 illustrates a further use of the slip-on brace 10, wherein two display stands 25 are supported at an angle to one another by the insertion of one brace flange 22 into the slot of one frame 25 and the opposite brace flange 24 into the slot of the other frame 25, so as to position the same at an angle of approximately 60 degrees to one another. A similar brace could be inserted on the opposite side of the display stand so as to enable the same to be rotated 90 degrees and displayed in the manner shown in FIG. 10 to produce a double-sided display stand.

Figure 11:
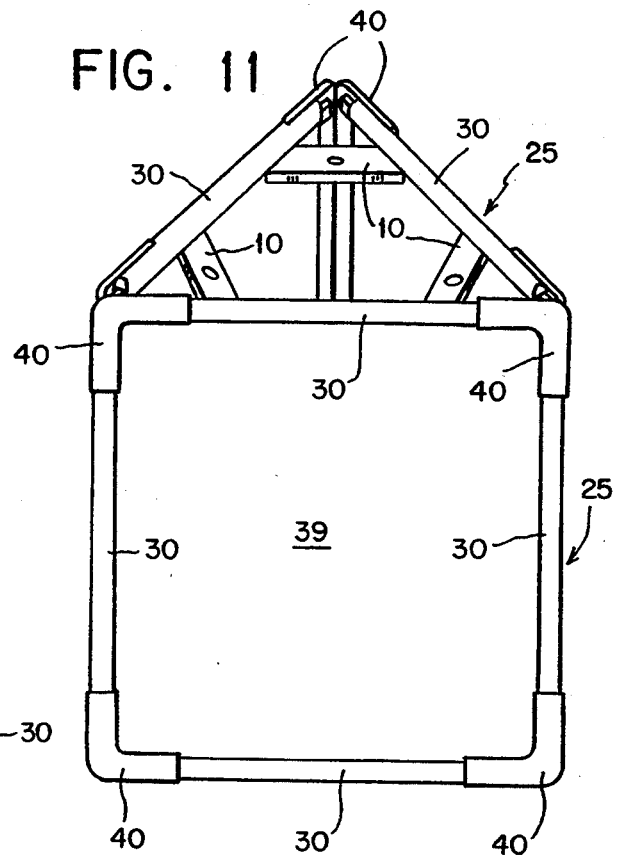
FIG. 11 is a perspective view showing the slip-on brace being used to form a triangular stand.

FIG. 11 shows three display stands being joined together in a triangularly configuration by the employment of three braces 10 at the top of each of the frames 25 and three braces at the bottom of each frame 25 (not shown).

Figure 12:
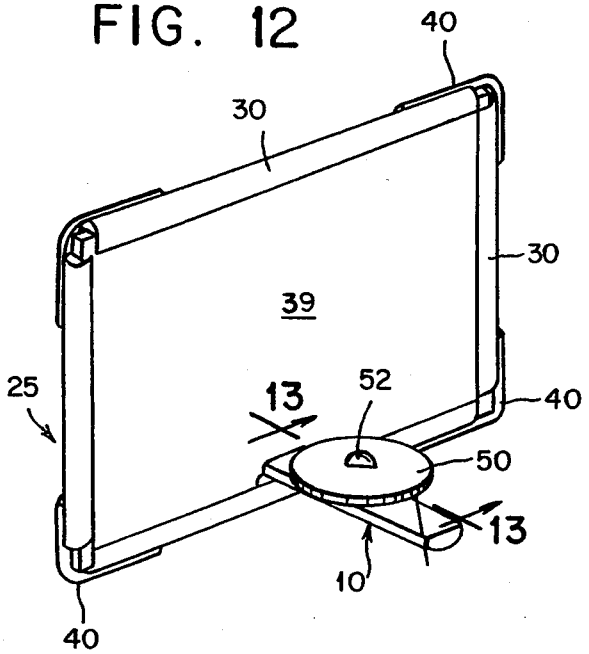
FIG. 12 is a perspective view showing the additional provision of a weight to the brace to provide additional stability.
Figure 13:
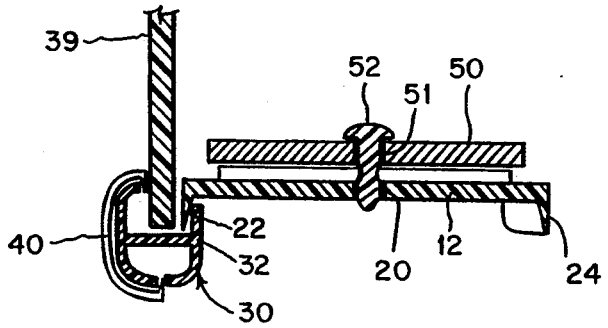
FIG. 13 is a sectional view taken along line 13—13 of FIG. 12.

FIGS. 12 and 13 illustrate the use of a weight 50 to provide additional stability to the frames supported by the slip-on brace. As seen clearly in FIG. 13, the weight 50 has a central bore 51 which may be aligned with the central bore 20 of the brace element 12 and a push-type, nail-like pin 52 may be frictionally inserted into them so as to secure the weight 50 to the brace element 10. Of course, other attachments means are possible. Although not illustrated, as a further addition to the slip-on braces of the present invention, flexible hinges of the type disclosed in my co-pending application for a flexible hinge for display frames and stands filed concurrently herewith, could be used for providing additional support to the combined display stands.

While only several embodiments of the present invention have been shown, various modifications can be made as will be apparent to those skilled in the art. For example, while the flanges of the hinges are preferably disposed at an angle of 60 degrees, this can of course be modified to suit the particular application. In addition, the brace may be made of injection molded plastic.

Thus, while only several embodiments of the present invention have been shown and described, it is obvious that many changes and modification may be made thereunto without departing from the spirit and scope of the invention.

What is claimed is:

1. A slip-on brace for display stands, frames and easels of the type having an elongated frame element having front and rear legs defining a slot for the receipt of a generally planar display element, comprising:

a generally planar brace element having two opposite lateral edges angularly disposed relative to one another to define an included angle of 60 degrees; and a pair of upstanding flanges each of which is joined to and along one of said lateral edges and is disposed generally normally to said planar brace element, at least one of said flanges being insertable into the slot of the elongated frame element in a friction fit manner between the display element and the frame element rear leg.

2. The slip-on brace according to claim 1, wherein said brace element and flanges are integrally formed from plastic material.

3. The slip-on brace according to claim 1, additionally including a weight removably securable to said brace element.

4. The slip-on brace according to claim 1, wherein said flanges are tapered.

5. The slip-on brace according to claim 1, wherein the brace is made from injection molded plastic.

6. The slip-on brace according to claim 1, wherein said brace element has a pair of elongated reinforced ribs formed thereon.

7. The slip-on brace according to claim 1, wherein the brace element has at least one hole thereon by which the brace may be hung.

8. A slip-on brace for a plurality of display stands, frames and easels of the type having an elongated frame element having front and rear legs defining a slot for the receipt of a generally planar display element, comprising:

a generally planar brace element having two opposite lateral edges angularly disposed relative to one another; and a pair of upstanding flanges each of which is joined to and along one of said lateral edges and is disposed generally normally to said planar brace element, at least one of said flanges being insertable into the slot of the elongated frame element in a friction fit manner between the display element and the frame element rear leg, and the other of said flanges being insertable into the slot of another elongated frame element of another display stand in a friction fit manner between the display element and the frame element rear leg so as to join said frame elements and stands together at an angular position with respect to one another.

9. The slip-on brace according to claim 8, additionally including a weight removably securable to said brace element.

10. The slip-on brace according to claim 8, wherein said brace element and said weight has a central bore, and wherein said brace additionally includes a removable push-type, nail-like pin clip frictionally receivable in said bores of said brace element and weight in a snap-fit manner.

11. The slip-on brace according to claim 8, wherein said flanges are tapered.

12. The slip-on brace according to claim 8, wherein the brace is made from injection molded plastic.

13. The slip-on brace according to claim 8, wherein said brace element has a pair of elongated reinforced ribs formed thereon.

14. A multiple display stand and brace assembly comprising:

a plurality of display stands each having a frame element having front and rear legs defining a slot for the receipt of a generally planar display element; and a plurality of slip-on braces for joining said display stands together at an angular position with respect to one another, said braces each including a generally planar brace element having two opposite lateral edges angularly disposed relative to one another and a pair of upstanding flanges each of which is joined to and along one of said lateral edges and is disposed generally normally to said planar brace element, at least one of said flanges being insertable into the slot of one of the elongated frame elements of one display stand in a friction fit manner between the display element and the frame element rear leg, and the other of said flanges being insertable into the slot another elongated frame element of another display stand in a friction fit manner between the display element and the frame element rear leg so as to join said frame elements and stands together at an angular position with respect to one another.

15. The multiple display stand and brace assembly according to claim 14, additionally including a weight removably securable to said brace element.

16. The multiple display stand and brace assembly according to claim 14, wherein said brace element and said weight has a central bore, and wherein said brace additionally includes a removable push-type, nail-like pin clip frictionally receivable in said bores of said brace element and weight in a snap-fit manner.

17. The multiple display stand and brace assembly according to claim 14, wherein said flanges are tapered.

18. The multiple display stand and brace assembly according to claim 14, wherein the brace is made from injection molded plastic.

19. A slip-on brace for display stands, frames and easels of the type having and elongated frame element having front and rear legs defining a slot for the receipt of a generally planar display element, comprising:

a generally planar brace element having two opposite lateral edges angularly disposed relative to one another;

a pair of upstanding flanges each of which is joined to and along one of said lateral edges and is disposed generally normally to said planar brace element, at least one of said flanges being insertable into the slot of the elongated frame element in a friction fit manner between the display element and the frame element rear leg; and a weight removably securable to said brace element.

20. The slip-on brace according to claim 19, wherein said lateral edges of said brace define an included angle of 60 degrees.

21. The slip-on brace according to claim 19, wherein said brace element and said weight has a central bore, and wherein said brace additionally includes a removable push-type, nail-like pin clip frictionally receivable in said bores of said brace element and weight in a snap-fit manner.

22. A slip-on brace for display stands, frames and easels of the type having an elongated frame element having front and rear legs defining a slot for the receipt of a generally planar display element, comprising:

a generally planar brace element having two opposite lateral edges angularly disposed relative to one another, said brace element having a pair of elongated reinforced ribs formed thereon; and a pair of upstanding flanges each of which is joined to and along one of said lateral edges and is disposed generally normally to said planar brace element, at least one of said flanges being insertable into the slot of the elongated frame element in a friction fit manner between the display element and the frame element rear leg.

23. A slip-on brace for display stands, frames and easels of the type having an elongated frame element having front and rear legs defining a slot for the receipt of a generally planar display element, comprising:

a generally planar brace element having two opposite lateral edges angularly disposed relative to one another, said brace element having at least one hole thereon by which the brace may be hung; and a pair of upstanding flanges each of which is joined to and along one of said lateral edges and is disposed generally normally to said planar brace element, at least one of said flanges being insertable into the slot of the elongated frame element in a friction fit manner between the display element and the frame element rear leg.

* * * * *